United States Patent [19]

Hovis, Jr. et al.

[11] 4,011,076

[45] Mar. 8, 1977

[54] METHOD FOR FABRICATING BERYLLIUM STRUCTURES

[75] Inventors: Victor M. Hovis, Jr., Kingston; Walter G. Northcutt, Jr., Oak Ridge, both of Tenn.

[73] Assignee: The United States of America as represented by the United States Energy Research and Development Administration, Washington, D.C.

[22] Filed: Mar. 18, 1976

[21] Appl. No.: 668,023

[52] U.S. Cl. ..... 75/211; 75/200; 75/224; 75/225; 75/150; 148/126

[51] Int. Cl.[2] ..... B22F 3/00

[58] Field of Search ..... 75/150, 200, 211, 224, 75/225; 148/126

[56] References Cited

UNITED STATES PATENTS

| | | | |
|---|---|---|---|
| 3,791,851 | 2/1974 | Taylor et al. | 75/200 |
| 3,793,014 | 2/1974 | Rossenwasser | 75/200 |
| 3,853,549 | 12/1974 | Baird et al. | 75/200 |

FOREIGN PATENTS OR APPLICATIONS

| | | |
|---|---|---|
| 1,118,003 | 6/1968 | United Kingdom |
| 1,088,049 | 10/1967 | United Kingdom |

*Primary Examiner*—Brooks H. Hunt
*Attorney, Agent, or Firm*—Dean E. Carlson; David S. Zachry; Earl L. Larcher

[57] ABSTRACT

Thin-walled beryllium structures are prepared by plasma spraying a mixture of beryllium powder and about 2500 to 4000 ppm silicon powder onto a suitable substrate, removing the plasma-sprayed body from the substrate and placing it in a sizing die having a coefficient of thermal expansion similar to that of the beryllium, exposing the plasma-sprayed body to a moist atmosphere, outgassing the plasma-sprayed body, and then sintering the plasma-sprayed body in an inert atmosphere to form a dense, low-porosity beryllium structure of the desired thin-wall configuration. The addition of the silicon and the exposure of the plasma-sprayed body to the moist atmosphere greatly facilitate the preparation of the beryllium structure while minimizing the heretofore deleterious problems due to grain growth and grain orientation.

5 Claims, No Drawings

METHOD FOR FABRICATING BERYLLIUM STRUCTURES

The present invention is generally directed to the formation of thin-walled beryllium structures, and more particularly to the preparation of such thin-wall structures by plasma spraying a beryllium-silicon mixture onto a mandrel of the desired configuration and thereafter sintering the sprayed body to form the desired structure.

Beryllium metal, because of its unique physical, mechanical, and nuclear properties, has been found to be particularly suitable for use in nuclear and aerospace applications. However, several problems attendant with the fabrication of beryllium metal into useful structures have been encountered which considerably detract from the general use and acceptance of this metal for use in such applications. Primarily, these problems encountered in the fabrication of beryllium structures result from substantial grain orientation and crystal growth of polycrystalline beryllium with such orientation and crystal growth considerably reducing the strength of the structure while increasing the difficulty in forming the beryllium structures.

Historically, the production of sound beryllium ingots by melting and casting operations has been difficult due to a common tendency for oriented, highly stressed and coarse grains to appear upon solidification of the ingot which results in undesirable intergranular cracking and isotropy in the beryllium ingot. The large oriented grains and the natural brittleness of the beryllium cause considerable difficulty in utilizing conventional extrusion, rolling, and other metal working practices upon the beryllium metal so as to considerably limit the use of casting operations for forming finished beryllium structures.

The fabrication of beryllium structures by employing powder metallurgical techniques, especially hot pressing techniques, has been somewhat successful. However, it has been found that hot pressing techniques have not been particularly satisfactory for the preparation of thin-wall structures, such as cylinders and sheet material. Some of the shortcomings with hot-pressing techniques is that they normally require the formed structures to be finished to size by employing known rolling, milling, and other mechanical metal working operations which present problems in controlling and modifying the inherent characteristics of the worked beryllium, such as excessive orientation and grain size, high stresses, and cracking.

Another problem found in forming beryllium products by hot pressing and other known techniques is due to the presence of the non-metallic layers of beryllium oxide (BeO) and other beryllium compounds, such as nitrides and carbides, on the surface of the beryllium powder. In the hot-pressed body, these beryllium compounds possess thermally stable lattices which tend to form an inert barrier that substantially inhibits metal-to-metal contact during sintering which results in an inherently weak structure. The problems attendant with these compounds on the surface of the beryllium powder are well recognized and several efforts to overcome these problems have been attempted. For example, some modifications in the hot-pressing techniques have been made to overcome the difficulties of fabricating the beryllium structures, especially with respect to the presence of the BeO. As disclosed in prior art, Great Britain Pat. Nos. 1,088,049 and 1,118,003 which issued Oct. 18, 1967, and June 26, 1968, respectively, disclose that silicon, in elemental form may be mixed with the beryllium powder to facilitate sintering by minimizing the problems due to the BeO barriers. It is pointed out in these patents that by applying silicon to the powder particles the diffusion of the beryllium metal through the BeO and other surface compounds is achieved so as to enable satisfactory sintering to occur. It is also pointed out in one of these patents that the silicon could be introduced into the beryllium powder mass by coating the pressing vessel with a volatile organosilicon compound. While these prior art teachings yield some success, there are still some problems. For example, while the aforementioned patents teach the addition of silicon in concentrations up to about 1200 ppm to facilitate sintering, the resulting structure formed by hot pressing still possesses the known problems of forming beryllium structures since the sintered body must be finished to final size by employing conventional metal working techniques, such as machining, rolling, milling, etc., which encourages undesirable grain orientation, grain growth, cracking, and stressing properties in the beryllium product. Further, it is believed that the use of the organosilicon compound causes further difficulties in that it introduces some impurities, primarily carbon, into the beryllium powder along with the organosilicon compounds which considerably detracts from the beryllium article due to the presence of such impurities.

Accordingly, it is the primary objective of the present invention to substantially minimize or overcome the problems previously encountered in preparing beryllium structures, especially thinwalled structures, such as cylinders and sheet material. These objectives are achieved by plasma spraying an admixture of beryllium powder and about 0.25 to 0.40 weight percent silicon powder onto a substrate of the desired configuration. The sprayed body is removed from the substrate and a sizing die formed of a material having a coefficient of thermal expansion similar to that of the beryllium metal, and the plasma-sprayed body is then exposed to a humid atmosphere to effect sorption of moisture thereby. The plasma-sprayed body upon sorbing the desired quantity of moisture is then out-gassed and sintered. The addition of the silicon promotes sintering while the exposure of the plasma-sprayed body to a moist atmosphere effectively reduces the quantity and affects of surface compounds, such as beryllium oxide, with respect to the sintering operation.

Other and further objects of the invention will be obvious upon an understanding of the illustrative method about to be described, or will be indicated in the appended claims, and various advantages not referred to herein will occur to one skilled in the art upon employment of the invention in practice.

Described generally, the invention is directed to the fabrication of thin-walled beryllium structures in configuration, such as cylinders, cones, sheets, spheres, and the like with wall thicknesses in the range of about 30 to 500 mils. These beryllium structures are fabricated by practicing the steps of combining beryllium powder with elemental silicon in a concentration of about 0.25 to 0.40 weight percent (2500–4000 ppm), spraying the mixture by using conventional plasma-spraying techniques onto a mandrel for forming the structure of the desired configuration, removing the plasma-sprayed body from the mandrel and placing it within the cavity of a sizing die formed of a material having a coefficient of thermal expansion substantially similar to that of beryllium for controlling the dimensions of the body while preventing distortion thereof during the sintering operation, exposing the plasma-sprayed body while within the sizing die or therebefore to a moist atmosphere for effecting the sorption of water thereby to minimize the problems attendant with the presence of beryllium oxide on the beryllium, as will be explained in detail below, outgassing the plasma-sprayed body while in the sizing die in vacuum to a temperature of about 700°–800° C. to effect removal of undesirable volatile substances from the structure as well as beryllium oxide which combines with the water and is volatilized and driven off as a gas, sintering the plasma-sprayed body at a suitable temperature in an inert atmosphere for forming a thin-walled beryllium structure of the selected configuration which possesses controlled void volume, pore size distribution, and minimal deformation of the plasma-sprayed structures. The resulting sintered structure may then be used in its intended application with only minimal machining being required for effecting the precise dimensions of the finished article.

The beryllium powder employed in the invention is in a size range of about 35 to 53 microns which is suitable for spraying through a conventional plasma spray gun. However, if desired, smaller or larger beryllium particles may be satisfactorily used in the method of the present invention. The beryllium powder is of preferably a purity greater than 99.99 percent so as to minimize the presence of impurities therein which could be undesirable for use in nuclear applications.

The silicon powder employed in the method of the present invention, like the beryllium powder, is of a size range suitable for plasma spraying, and is preferably in a size range of about 4 to 30 microns. The silicon powder is used in the beryllium structure for the purpose of promoting the solid state diffusion of contiguous beryllium particles. The silcion remains in granular form throughout the plasma-spraying operation with homogeneously dispersed grains of silicon still being present in the sintered structure. It is believed that the presence of the silicon in the plasma-sprayed beryllium functions to promote the sintering due to the volatilization of surface portions of the silicon grains during the sintering operation with the resulting silicon vapor permeating or diffusing throughout the porous beryllium structure. These vapors tend to concentrate at the contact points of contigously disposed beryllium particles so as to promote solid state diffusion between such particles which facilitates the combining or the joining of these particles as well as densifying and strengthing the sintered product. The concentration of the silicon powder in the beryllium-silicon mixture prior to sintering is in the range of about 0.25 to 0.40 weight percent. This concentration of silicon is believed to be critical since a silicon powder concentration of less than about 0.25 weight percent is not sufficient to provide less than the maximum tolerable level of porosity in the plasma-sprayed free-standing beryllium structures during the sintering operation. For example, with a silicon concentration of about 0.15 weight percent the real density is near theoretical, but the bulk porosity is approximately 8 percent, which extent of porosity is undesirable because it indicates a significant degree of improper sintering of the material accompanied by substantial decreases in strength and ductility. On the other hand, a silicon concentration greater than 0.4 weight percent is undesirable because an excess will not contribute significantly to the sintering process but will significantly contribute to the quantity of impurities which are undesirable for a number of beryllium metal applications.

The beryllium powder-silicon powder mixture is first thoroughly blended to insure the uniform dispersion of the silicon particulates throughout the beryllium powder mass. This mixture is then sprayed onto a substrate of the desired configuration by employing a conventional plasma spray gun operable at a plasma-gas temperature in the range of about 8,000° to 11,000° C. The propellant gas or plasma-gas mixture utilized for plasma spraying the berylliumsilicon mixture may be argon, helium or mixtures thereof. The spray gun may be spaced a distance of about 2.5 to 5 inches from the substrate during the spraying operation.

The substrate, in turn, is of a material which is substantially non-adherent with the plasma-sprayed beryllium-silicon mixture so as to assure that the plasma-sprayed body may be removed therefrom without damage. Satisfactory substrate materials include graphite or aluminum oxide, or such materials covered with graphite flakes or foil. The thickness of the plasma-sprayed body for forming the finished thin-wall structure may be in the range of 30 to 500 mils since some shrinkage in the wall thickness occcurs during the sintering operation.

After completing the plasma-spraying operation, the nonsintered plasma-sprayed body is removed from the substrate and placed within a sizing die constructed of a material having a coefficient of thermal expansion substantially similar to that of the beryllium metal so as to assure that undesirable stressing and distortion of the beryllium structure will not occur during the exposure to the high temperature sintering conditions. A satisfactory material which possesses a coefficient of thermal expansion sufficiently similar to that of beryllium and may be used for forming the sizing die is tungsten-3.5 weight percent nickel-1.5 weight percent iron alloy which has a thermal expansion coefficient of $5.2 \times 10^6$ in/in/° C. Other suitable materials which may be used include graphite and molybdenum.

Prior to placing the plasma-sprayed body in the sizing die or thereafter, if desired, the plasma-sprayed body is exposed to a moist air environment. This step is important in the subject method in order to assure proper sorption and condensation of microscopic layers of liquid water within the porous plasma-sprayed structure. This sorption takes place by capillary attraction of water vapors within the porous beryllium body. The purpose of subjecting the plasma-sprayed body to a moist air environment is to overcome or minimize the sintering-inhibiting effect of the beryllium oxide layers at the contact points between contiguously disposed beryllium particles since, as pointd out above, these layers of beryllium oxide greatly inhibit the diffusion of beryllium atoms across the contact surfaces during sintering. It has been found that these beryllium oxide layers which are instantly formed upon exposing beryllium to oxygen present a barrier which must be overcome to provide a suitably sintered product. Thus, by exposing the plasma-sprayed beryllium body to the moist air atmosphere, the beryllium oxide or at least a substantial portion thereof may be volatilized and driven off as a gas, $Be(OH)_2$, which results from the beryllium oxide being placed in contact with liquid water and then heated slowly. Sufficient sorption of the water may be achieved by subjecting the plasma-sprayed beryllium body to a moist air environment which has a relative humidity level of at least about 30 percent for a duration of about 1 hour.

After completing the water sorption step and with the beryllium body in the sizing die, the beryllium body may be out-gassed to provide maximum vaporization of the BeO and thereby effecting removal of undesirable BeO layers from within the beryllium body. In addition to removing beryllium oxide from the plasma-sprayed beryllium body, volatile, impurities, such as oxygen, nitrogen, hydrocarbons, and water vapor, are removed. Also, the out-gassing minimizes any further oxidation of the beryllium body prior to and during the subsequent sintering step. The out-gassing step is preferably done in a furnace which may be used for the sintering operation. This out-gassing step may be accomplished by heating the beryllium body in vacuum at a temperature in the range of about 700°–800° C. until an out-gassing pressure in the range of about $10^{-6}$ to $10^{-7}$ torr is achieved.

Upon completion of the out-gassing, the pump-down is terminated and an inert gas, e.g., argon or helicum, is introduced into the furnace to pressurize the latter to a pressure in the range of about 1 to 5 psi absolute so as to prevent excessive loss of beryllium due to its high vapor pressure at elevated temperatures. After pressurizing, the die-encased beryllium body is subjected to a temperature in the range of about 1100°–1200° C for a duration of about 0.5 to 2.0 hours for effecting sintering of the beryllium body.

When the sintering operation is completed the sintered beryllium structure is allowed to cool in the argon atmosphere of the furnace to room temperature and is then removed for subsequent final machining, if required, and use.

In order to provide a more facile understanding of the present invention, an example set forth below relating to the preparation of cone-shaped structures is provided.

EXAMPLE

The beryllium-silicon mixture containing 0.3 weight percent silicon formed of beryllium and silicon powder having an average particle size of 45 and 12 microns, respectively, was prepared and sprayed through a plasma spray gun onto a conical mandrel coated with graphite foil flakes. Four cone-shaped beryllium bodies were sprayed in an argon atmosphere to a thickness in the range of 0.035 to 0.50 inch. Argon gas at a flow rate of 35 SCFH was used for the arc gas in the plasma spray gun which was run at an arc current of 380 amperes with an electro potential of 30 volts at a standoff distance of 4 inches. The plama-sprayed bodies were removed from the mandrel and placed within a conical die assembly formed of the aforementioned tungsten-nickel-iron alloy. The loaded die assemblies were then placed in a humid atmosphere at room temperature for 1 hour to effect the moisture absorption. Upon completion of the moisture absorption, the die assemblies were loaded into a vacuum furnace and out-gassed at a vacuum of $6 \times 10^{-7}$ torr to a temperature of 700° C. The vacuum pumping was maintained for a period of 30 minutes. Upon completion of the pumping operation, the vacuum was terminated and the pressure of the furnace increased to 127 torr with argon. The furnace was then heated to a temperature of 1200° C for 1 hour to sinter the beryllium particles. The sintered structures were cooled to room temperature in the furnace and then removed from the die for evaluation. The sintered structures which possessed a porosity of about 17 percent prior to sintering, had an average porosity of about 3 percent after sintering. The cones posessed a transverse rupture breaking stress in the range of about 32 to $67 \times 10^3$ psi and a transverse rupture elastic modulus in the range of 22 to $33 \times 10^6$ psi. The end silicon content was about 0.30 percent so as to indicate that virtually all of the silicon metal remained throughout the fabrication of the beryllium structures thereof.

It will be seen that the present invention provides a satisfactory technique for fabricating thin-walled beryllium structures wherein the problems heretofore encountered due to grain growth and crystal orientation are substantially minimized. The thinwalled structures are sound and are able to be fabricated to within tolerances to essentially those required of the final product. The evaluation of the beryllium structures indicate that the physical, mechanical, and chemical properties will be satisfactory for known applications in aerospace and nuclear industries.

What is claimed is:

1. A method for fabricating a thin-walled beryllium structure, comprising the steps of preparing a mixture of beryllium powder and elemental silicon powder with a concentration of silicon in a range of about 2500 to 4000 ppm, plasma spraying the mixture onto a substrate, removing the sprayed body from the substrate, exposing the plasma-sprayed body to a moist atmosphere for a duration sufficient to effect absorption of liquid water therein, confining the sprayed body within a sizing die having coefficient of thermal expansion substantially similar to that of beryllium, out-gassing the plasmasprayed body in vacuum at an elevated temperature, and thereafter sintering the plasma-sprayed body in an inert atmosphere.

2. The method claimed in claim 1, wherein the beryllium powder has a particle size in the range of 35 to 53 microns, and wherein the silicon powder has a particle size in the range of 4 to 30 microns.

3. The method claimed in claim 1, wherein the step of exposing the plasma-sprayed body to the moist atmosphere is achieved by exposing the plasma-sprayed body to an air atmosphere having a relative humidity level of at least 30 percent for a duration of at least 1 hour.

4. The method claimed in claim 3, wherein the out-gassing step is achieved by heating the die-confined plasma sprayed body to a temperature in the range of 700°–800° C. under a vacuum at a pressure in the range of $1 \times 10^{-6}$ to $1 \times 10^{-7}$ torr, and wherein sintering step is achieved in an inert atmosphere at a pressure in the range of 1 to 5 psia and at a temperature in the range of 1100°–1200° C.

5. The method claimed in claim 4, wherein the steps of outgassing and sintering occur in a vacuum furnace without exposing the out-gassed plasma-sprayed body to an oxidizing atmosphere prior to the sintering step.

* * * * *